United States Patent [19]

Miller

[11] 4,292,748

[45] Oct. 6, 1981

[54] CLAMP STAND FOR NEEDLEWORK FRAMES

[76] Inventor: Betty J. Miller, 1509 Ballard, East Brewton, Ala. 36426

[21] Appl. No.: 943,741

[22] Filed: Sep. 19, 1978

[51] Int. Cl.[3] ..... D05C 1/04; A47B 97/04

[52] U.S. Cl. ..... 38/102; 38/102.2; 38/102.4; 108/43; 248/444

[58] Field of Search ..... 38/102, 102.2, 102.4; 289/18 R, 18 M; 108/43; 248/444

[56] References Cited

U.S. PATENT DOCUMENTS

| | | | |
|---|---|---|---|
| 1,016,463 | 2/1912 | Wilkins | 38/102.2 |
| 3,730,077 | 5/1973 | Selden | 108/43 |
| 3,750,312 | 8/1973 | Bucher | 108/43 X |
| 3,774,326 | 11/1973 | Selden | 38/102.4 |
| 3,906,648 | 9/1975 | Bard | 38/102.2 |
| 3,991,966 | 11/1976 | Breer | 108/43 |
| 4,124,237 | 11/1978 | Catania | 289/18 M |

FOREIGN PATENT DOCUMENTS

| | | | |
|---|---|---|---|
| 911066 | 5/1946 | France | 108/43 |

OTHER PUBLICATIONS

"Needle-Ease", an advertisement.

*Primary Examiner*—Louis Rimrodt
*Attorney, Agent, or Firm*—Harvey B. Jacobson

[57] ABSTRACT

A holder for a needlework frame usable by a seated operator includes a base member upon which the operator may sit and a support member pivotally attached to the base member from which a clamp bar for holding the needlework frame extends. The needlework frame is attached to the clamp bar through the use of a C-clamp and the clamp bar may be vertically adjusted above the lap of the operator through the use of a longitudinal slot provided in the support post, while the clamp bar may also be rotated about its horizontal axis so as to adjust the angle of the needlework frame relative to the operator. The clamp bar may be removed and the support post may then be pivotally collapsed against the base member to facilitate storage and transporting of the holder.

1 Claim, 7 Drawing Figures

CLAMP STAND FOR NEEDLEWORK FRAMES

BACKGROUND OF THE INVENTION

1. Field of the Invention

Needleworkers like to take their work with them wherever they go, and they work on their projects in cars while traveling, on planes, in waiting rooms, in motel rooms, and at other times and places where a suitable opportunity is provided. The present invention facilitates the ability to perform needleworking skills conveniently, comfortably, and effectively by freeing both hands of the needleworker. The device of the invention is lightweight and portable for easy transporting to desired work locations.

2. Description of the Prior Art

Needlework stands presently available are characterized by numerous shortcomings and disadvantages. For example, available portable stands do not provide for reversing the work so that an operator can finish off or begin yarns and threads. Moreover, available portable stands are not adjustable vertically to conform to the most comfortable and convenient orientation of the needleworker's hand, nor do they rotate the angle of work area or permit adjustment of the angle of tilt to the most suitable and convenient position. As needlework proceeds from region to region on the cloth surface held by a needlework frame, fatigue and inconvenience to the needleworker are created through the use of prior needlework frames, which lack such adjustability.

Further, prior art needlework stands are not easily transportable from location to location, nor are available portable stands collapsible for forming a compact assembly which can be carried about conveniently.

A baby bottle holder of self-feeding type is disclosed in U.S. Pat. No. 3,298,648, to Sepanski, issued Jan. 17, 1967, where a vertical post with longitudinal slots provide adjustable means for supporting a rotatable arm. No suggestion of portability or application to needleworking applications is suggested in the Sepanski patent.

U.S. Pat. No. 3,955,722, issued May 11, 1976, to Bard, shows a non-portable apparatus for supporting a needlework frame, including a baluster column with an adjusting block slidably and rotatably mounted on the upper portion of the column to carry a needlework, while U.S. Pat. No. 3,938,267, issued Feb. 17, 1976, to Bard, shows an apparatus for supporting a needlework frame in a plurality of adjustable positions, where the working frame is held on a dowel rod mountable in a space between a pair of upright posts.

Other devices for sewing or knitting are shown by Beaton in U.S. Pat. No. 2,417,149, issued Mar. 11, 1947, showing a sewing frame to facilitate hand sewing operations, and by Pridham in U.S. Pat. No. 4,033,537, issued July 5, 1977, showing a non-portable stand for a knitting machine. The drawback of the hand-held sewing frame of Beaton is that it is necessary to manually hold the needlework frame, thus occupying one hand when it is necessary to hold the work.

SUMMARY OF THE INVENTION

A base, support post, and clamp bar for supporting a needlework hoop or frame comprise the basic elements of the invention. The support post folds flat against the base to collapse into a package easily fitting into a suitable carrier after disassembly of the removable clamp bar.

The position of the clamp bar is vertically adjustable on the support post and independently rotatable for adjustment over the lap of a sitting user of the device, whose thighs rest upon the long, narrow base intended to fit comfortably thereunder.

Accordingly, it is an object of the invention to provide a needlework frame clamp stand which facilitates the ability of a needleworker to use both hands for the performance of needleworking skills.

Another object of the invention is to provide a portable needlework frame clamp stand for use by a needleworker when provided a suitable opportunity.

Still another object of the invention is to provide a portable needlework stand which permits vertical adjustment of a needlework hoop or frame and which permits rotation of the frame about a horizontal axis.

A further object of the invention is to provide a needlework clamp stand adaptable for use with square, rectangular, circular or other shapes of needlework frames and hoops.

A still further object of the invention is to provide a needlework clamp stand with a base made from a long narrow material intended to fit comfortably under the thighs of a user.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
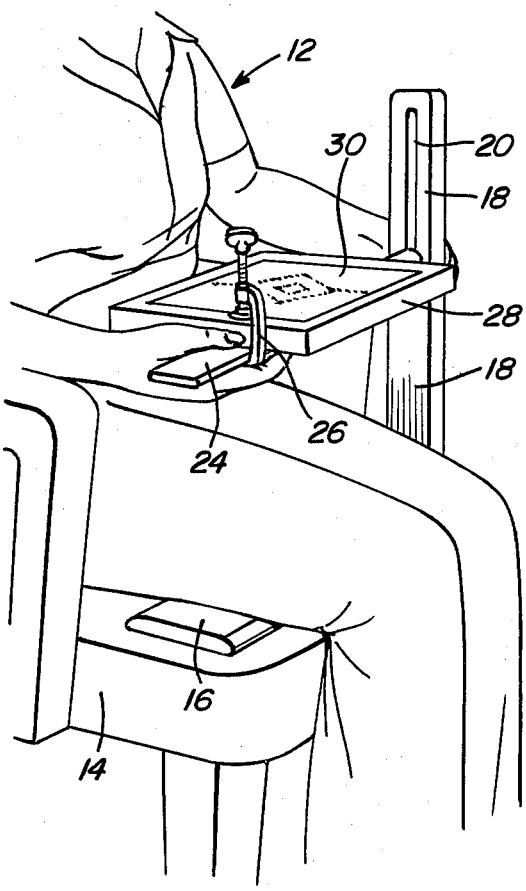
FIG. 1 is a perspective view of the device of the present invention positioned for adjustment by a user.
Figure 2:
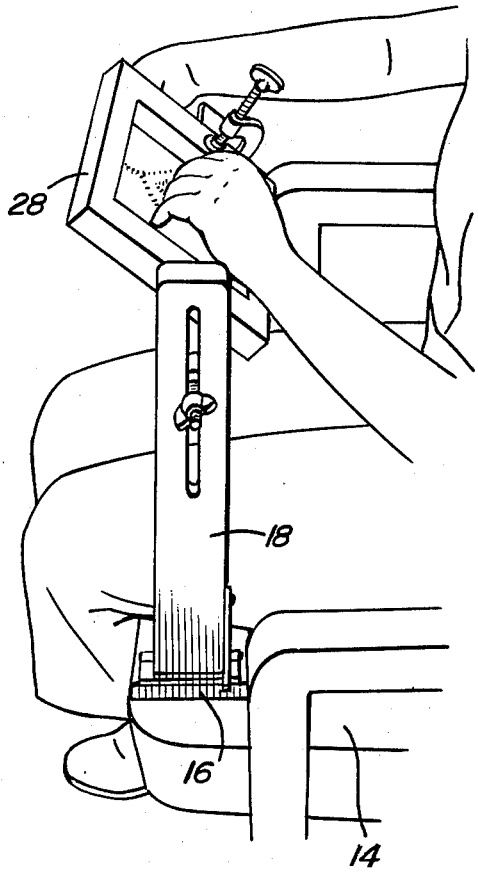
FIG. 2 is a perspective view of the device of the invention actually in use by a needleworker.

FIG. 1 shows the needlework clamp frame device 10 undergoing adjustment by the user 12 while seated in a chair 14. FIG. 2 shows device 10 in actual use for needleworking by needleworker 12 after adjustment to a convenient angle and height. In this respect, device 10 includes a base 16 positioned under the thighs of needleworker 12, and a support post 18 having a longitudinal slot 20 for receiving a fastening device 22. The fastening device 22 holds a clamp bar 24 to the support post 18. A C-clamp 26 clamps a needlework frame 28 to the clamp bar 24 so as to free the hands of needleworker 12 for needleworking operations on fabric 30, which is stretched across needlework frame 28 and attached about the periphery thereof by tacking, stapling, or other conventional means. Needlework fabric 30 can be attached to frame 28 on the side facing operator 12, as in FIG. 1, or frame 28 can be mounted on clamp bar 24 with the fabric 30 facing away from the needleworker 12, as shown in FIG. 2.

Figure 3:
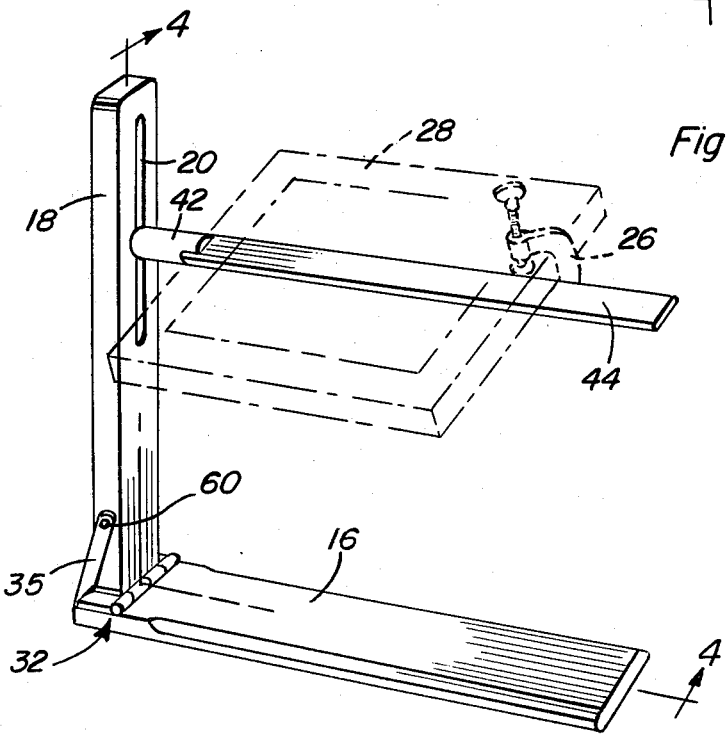
FIG. 3 is a perspective view of the clamp stand assembly, showing an associated clamp and needlework frame in phantom.

In FIG. 3, greater detail of the arrangement of assembled device 10 is shown, including hinge 32 and latch 35 for holding the support post 18 upright and locking it in position with respect to the base 16. Needlework frame 28 and clamp 26 are shown in phantom in FIG. 3.

Figure 4:
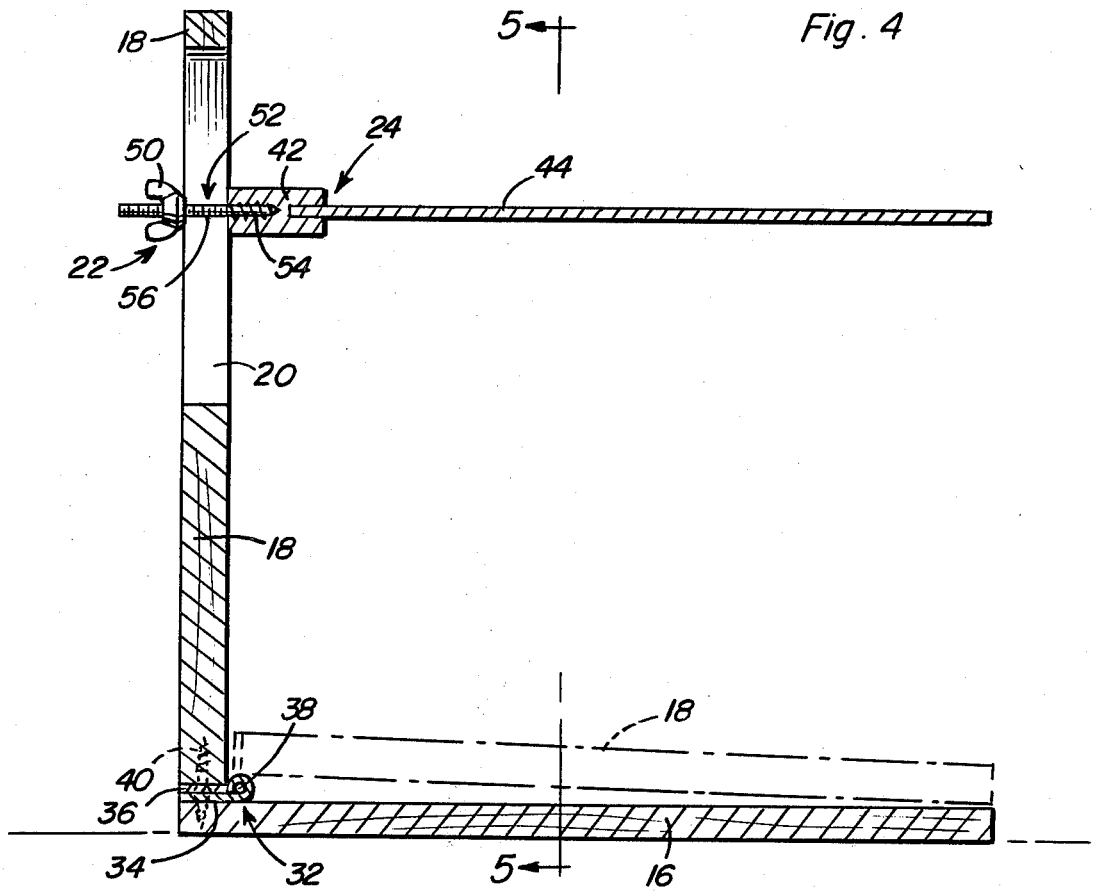
FIG. 4 is a sectional view of the clamp stand assembly of FIG. 3, taken substantially upon a plane passing along section line 4—4 of FIG. 3, showing in phantom the position of the support rod in a collapsed configuration.

FIG. 4 shows in greater detail the clamp bar fastening means 22, and further shows the collapsed position in phantom of support post 18, which is collapsible after removal of clamp bar 24 through fastening means 22. Hinge 32 including a base hinge plate 34, a support post hinge plate 36, and a pivot shaft 38 about which curled fingers from plates 34 and 36 are rotatably secured. Support post hinge plate 36 is shown in FIG. 4 engaged to the support post 18 by wood screws 40, and similar wood screws 41 hold base hinge plate 34 to base 16. Clamp bar 24 is made from a dowel rod 42 and an elongated flattened arm 44, which is inserted in slot 46 of dowel rod 42 and attached thereto by suitable means, such as an adhesive or glue of suitable composition. Alternatively, clamp bar 24 can be of a unitary construction, such as might be shaped by conventional woodworking techniques from a cylindrical wooden rod of suitable diameter and length. The length of clamp bar 24 is chosen to accommodate the length of the needlework frame 28, and a plurality of clamp bars 24 can be provided having varying lengths to suit the frame size. Fastening means 22 comprises wing nut 50 and support shaft 52, which is provided with wood screw threads 54 at one end for permanent insertion in dowel rod 42, and with machine threads 56 at the opposite end for receiving the compatibly threaded wing nut 50. To assemble the device, support shaft 52 of clamp bar 24 is inserted through longitudinal slot 20 of support post 18 to place arm 44 directly above base 16 at the desired height. A tightening of the wing nut 50 on the support shaft 52 will bring the dowel rod 42 into contact with the portions of support post 18 surrounding slot 20 and frictional engagement resulting thereby holds clamp bar 24 firmly in place.

Figure 5:
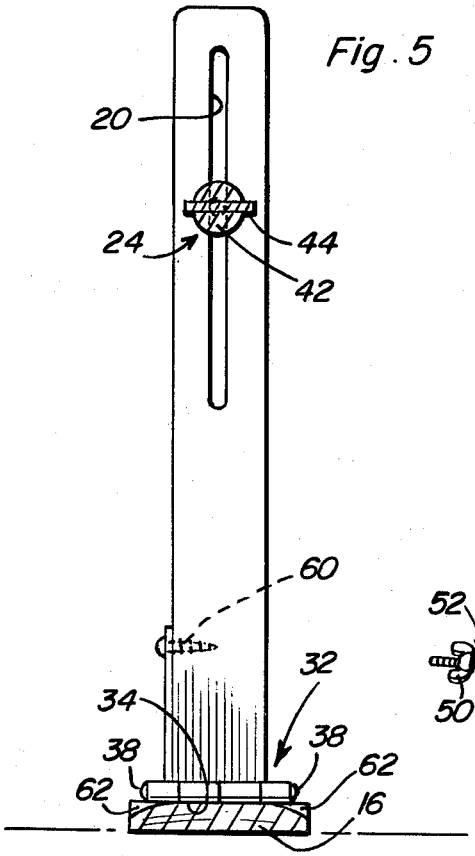
FIG. 5 is a transverse sectional view of the device of FIG. 4, taken substantially upon a plane passing along section line 5—5 of FIG. 4.

FIG. 5 shows clamp bar 24 in position and also shows the means of attachment of latch 35, namely, wood screw 60. Beveled edges 62 of base 16 are optionally present in order to provide a more comfortable resting surface for the user.

Figure 6:
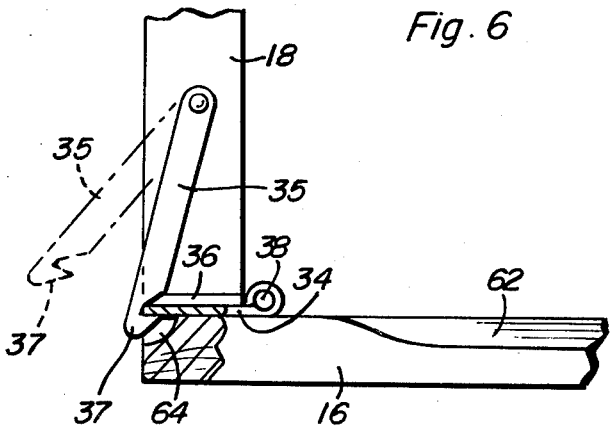
FIG. 6 is an enlarged side elevational view of the collapsible hinge assembly of the device, partly in section, showing the locking mechanism of the hinge in locked configuration, and (in phantom) the unlocked configuration.
Figure 7:
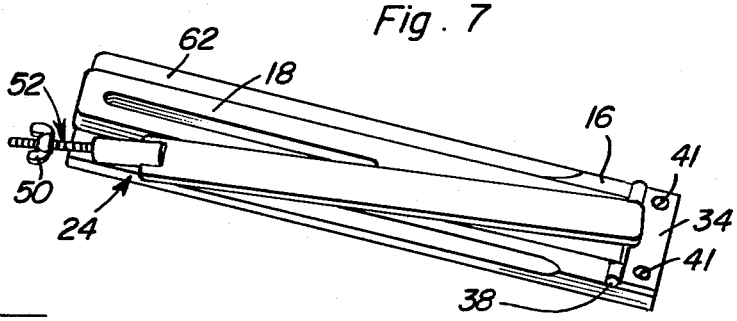
FIG. 7 is a perspective view of the device when disassembled and collapsed for storage or for carrying in a suitable container or carrier.

FIG. 6 shows latch 35 engaged beneath base hinge plate 34 in a locking position for maintaining the support post 18 substantially perpendicular to base 16. Recess 64 in base 16 provides a receiving space for the distal end 37 of latch 35 for hooking engagement beneath base hinge plate 34. Latch 35 is free to pivot outwardly about wood screw 60 to the position shown in phantom in FIG. 6, thereby permitting the support post 18 and the support post hinge plate 36 to pivot clockwise about the pivot shaft 38, and thus further permitting the device 10 to collapse into the carrying or stored position illustrated in FIG. 7, where clamp bar 24 has been disassembled and support post 18 has been collapsed as aforedescribed to rest upon base 16.

Clamp stand device 10 will hold needlework frames or needlework hoops at any convenient angle and at any independently adjustable height along slot 20, and with the frame or hoop having the associated fabric facing or directed away from the operator. When base 16 is sat upon, as illustrated in FIGS. 1 and 2, clamp bar 24 extends across the lap of a needleworker 12 at a comfortable position, leaving both hands of the needleworker free for performing needlework operations. Device 10 collapses to a package which easily fits into a needlework tote bag (not shown) upon release of support post 18 by latch 35, as described above, following the removal of clamp bar 24. When in use, device 10 can hold an embroidery hoop, a stretched crewel piece, or a needlepoint which has been mounted on a suitable stretcher frame of square, rectangular, circular, or other shape. Device 10 is lightweight when constructed of suitable materials, such as wood, while the device is both sturdy and simple to assemble and disassemble, thereby being adapted for use under a wide variety of conditions, and the device can be taken for use to almost any location where a needlework operator can sit. The support can accommodate a variety of needleworking frames, including hoops, stretcher frames, and scroll frames of small size. These needleworking frames are well known in the art and are of conventional construction. Needleworkers, as is well known, like to take their work with them wherever they go, and they commonly work on their projects in automobiles, planes, waiting rooms, in motel rooms, and the like. With the device 10, both hands are free to perform the complicated and precise skills of needleworking wherever the needleworker may be located, and the portability of device 10 contributes materially to this utility.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A portable needlecraft stand for supporting a needlecraft working frame, said stand comprising:

base means normally positionable on a seat so as to permit a needlecraft craftsman to sit thereon thus supporting said needlecraft stand;

support means pivotally hingedly attached to said base means and being substantially orthogonally positioned relative thereto when said stand is being used by said needlecraft craftsman and being selectively collapsible into a folded position against said base means when it is desired to store or transport said stand;

locking means operable to secure said support means in substantially orthogonal alignment with said base means, said locking means including a latch means pivotally attached to said support means and being engagable in a recess formed on said base means, said recess being formed partially by a slot cut into a portion of said base means and further being formed by one surface of a hinge fixedly secured to said base means, said hinge being further attached to said support means so as to permit a pivotal movement of said support means relative to said base means, said latch means being directly engageable with one surface of said hinge, said latch means further being selectively movable out of engagement with said recess when it is desired to collapse said support means against said base means thereby to store or transport said stand;

working frame holding means to which said working frame is fixedly securable, said holding means including a clamp bar lying in substantially parallel alignment with said base means and being substantially orthogonally positioned relative to said support means, said holding means being adjustably movable along a portion of said support means so as to vary a distance between said holding means and said base means thereby to accommodate the needs of a needlecraft craftsman sitting on said base means, said holding means further being rotatable along a horizontal axis thereof so as to vary an angle in space of said working frame fixedly secured thereto;

gripping means operably associated with said holding means and being selectively releasable to permit adjustable heightwise movement and rotation of said holding means, said adjustable heightwise movement of said holding means relative to said support means being afforded through the use of a longitudinal slot positioned within said support means, said gripping means being selectively releasable to permit said movement of said holding means within said slot, such selective release of said gripping means to afford a movement of said holding means within said longitudinal slot also permitting said holding means to be selectively rotated along said longitudinal axis thereof, said gripping means including a support shaft and a wingnut, said support shaft having machine screw threads on one end thereof to permit said wingnut to be threadably secured thereto and further having wood screw threads on another end thereof so as to permit said support shaft to be threadedly secured to said holding means, said holding means being positioned on one side of said support means proximate to said longitudinal slot and said wingnut being positioned on another side of said support means proximate to said longitudinal slot, said support shaft extending through said longitudinal slot whereby a tightening of said wingnut on said support shaft effects a gripping action of said holding means against said support means, said holding means being formed of a dowel portion and a flat bar portion, said dowel portion having said wood screw threads of said support shaft longitudinally positioned therein and further including a slot formed in one end thereof, said flat bar portion being fixedly secured within said dowel slot; and clamping means for fixedly securing said working frame to said holding means, said clamping means being selectively removable from and attachable to said holding means to facilitate the attachment and removal of said working frame relative to said holding means, said clamping means comprising a C-clamp which is manually attachable to and removable from said holding means.

* * * * *